US011338953B2

(12) United States Patent
Klok et al.

(10) Patent No.: US 11,338,953 B2
(45) Date of Patent: May 24, 2022

(54) HOT FILL CONTAINER WITH CORNER SUPPORT COLUMN

(71) Applicant: The Coca-Cola Company, Atlanta, GA (US)

(72) Inventors: Jeffrey Klok, Atlanta, GA (US); Sterling Lane Steward, Douglasville, GA (US); Venkat Govindarajan, Duluth, GA (US); Feng Shi, Marietta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 71 days.

(21) Appl. No.: 16/611,626

(22) PCT Filed: May 9, 2018

(86) PCT No.: PCT/US2018/031782

§ 371 (c)(1),
(2) Date: Nov. 7, 2019

(87) PCT Pub. No.: WO2018/208903

PCT Pub. Date: Nov. 15, 2018

(65) Prior Publication Data

US 2020/0062439 A1 Feb. 27, 2020

Related U.S. Application Data

(60) Provisional application No. 62/504,076, filed on May 10, 2017.

(51) Int. Cl.
*B65D 1/02* (2006.01)
*B65D 79/00* (2006.01)

(52) U.S. Cl.
CPC ..... *B65D 1/0276* (2013.01); *B65D 79/0084* (2020.05); *B65D 2501/009* (2013.01);
(Continued)

(58) Field of Classification Search
CPC .. B65D 1/0276; B65D 79/005; B65D 79/008; B65D 79/0084; B65D 2501/0027;
(Continued)

(56) References Cited

U.S. PATENT DOCUMENTS 5,238,129 A * 8/1993 Ota ..... B65D 1/0223 215/381
7,051,892 B1 * 5/2006 O'Day, Jr. ..... B65D 1/0223 215/10

(Continued)

FOREIGN PATENT DOCUMENTS

WO 02/070355 A1 9/2002
WO 2010/075252 A2 7/2010
WO 2013/052284 A1 4/2013

OTHER PUBLICATIONS

Extended EP Search Report for EP 18799279.7, dated Feb. 5, 2021. (8 pp.).

(Continued)

*Primary Examiner* — Ernesto A Grano
(74) *Attorney, Agent, or Firm* — Eversheds Sutherland (US) LLP

(57) ABSTRACT

The present application provides a container for a beverage filled in a hot fill process. The container may include a finish, a body section, and a base. The body section may include a number of support columns and a number of body panels. Each of the support columns may include a first raised mid-section extending into a first body panel and a second raised mid-section extending into a second body panel.

13 Claims, 3 Drawing Sheets

(52) U.S. Cl.
CPC ..... *B65D 2501/0027* (2013.01); *B65D 2501/0036* (2013.01); *B65D 2501/0081* (2013.01)

(58) Field of Classification Search
CPC .... B65D 2501/0036; B65D 2501/0081; B65D 2501/009; B65D 23/102; A45F 3/20
USPC ..... 215/381, 382, 383
See application file for complete search history.

(56) References Cited

U.S. PATENT DOCUMENTS

| | | | | |
|---|---|---|---|---|
| 7,581,654 | B2 | 9/2009 | Stowitts | |
| 8,186,529 | B2 | 5/2012 | Kinmont et al. | |
| 2005/0127024 | A1* | 6/2005 | Darr | B65D 41/14 215/382 |
| 2008/0245762 | A1* | 10/2008 | Matsuoka | B65D 1/0223 215/383 |
| 2012/0219738 | A1 | 8/2012 | Boukobza | |
| 2012/0305518 | A1 | 12/2012 | Ladina et al. | |
| 2013/0008913 | A1 | 1/2013 | Boukobza | |
| 2013/0228249 | A1 | 9/2013 | Gill | |
| 2016/0176605 | A1 | 6/2016 | Pritchett et al. | |

OTHER PUBLICATIONS

International Search Report and Written Opinion, PCT/US2018/031782, dated Aug. 28, 2018 (9 pp.).

* cited by examiner

HOT FILL CONTAINER WITH CORNER SUPPORT COLUMN

TECHNICAL FIELD

The present application and the resultant patent relate generally to beverage containers and more particularly relate to lightweight beverage bottles with corner support columns providing increased rigidity for accommodating the forces typically associated with hot fill processes in a highly aesthetic design.

BACKGROUND OF THE INVENTION

Beverages such as sport drinks, juices, teas, waters, and the like are often bottled via hot fill processes so as to prevent microbial growth. The hot fill processes generally involve pasteurizing the beverage at about 95 degrees Celsius for about 20 seconds, cooling the beverage to about 85 degrees Celsius, and then filling the bottles with the beverage. The 85 degree temperature generally is sufficient to sterilize the bottles. A closure is then applied to the bottle to create a sealed container. The bottle then may be passed through a cooling tunnel after filling and capping to be cooled via a water spray or other methods. The final temperature of the beverage after the cooling process generally may be less than about 40 degrees Celsius. Other types of hot fill processes may be known using different times, temperatures, and equipment. Different types of beverages also may necessitate different types of bottling techniques.

During the cooling process, the beverage may contract such that a vacuum forms within the enclosed container. To help offset the impact of such a vacuum, bottles used in the hot fill processes generally have special vacuum panels formed therein. These vacuum panels and the areas therebetween generally promote a controlled deformation or deflection so as to accommodate the forces created by the vacuum while maintaining the overall integrity of the bottle. These hot filled bottles generally require relatively complex shapes and may use significantly more thermoplastic material as compared to cold filled bottles and the like. As a result, hot fill bottles may be more expensive to produce in terms of both tooling and material and also may offer less design freedom.

There is thus a desire for improved hot fill containers and methods of filling the same. Such improved containers may accommodate the contraction of a beverage therein while maintaining the overall integrity of the container without the complexity, the weight, and the costs typically associated with hot fill containers and the like.

SUMMARY OF THE INVENTION

The present application and the resultant patent thus provide a container for a beverage filled in a hot fill process. The container may include a finish, a body section, and a base. The body section may include a number of support columns and a number of body panels. Each of the support columns may include a first raised mid-section extending into a first body panel and a second raised mid-section extending into a second body panel.

The present application and the resultant patent further provide a method of bottling a hot liquid. The method may include the steps of positioning a support column with a first raised mid-section and a second raised mid-section at each corner of the container, filling the container with the hot liquid, cooling the container, forming a vacuum within the container, and pulling the support columns towards each other.

The present application and the resultant patent further provide a 250 milliliter square container. The container may include a finish, a body section with four corners, and a base. The body section may include a number of support columns and a number of body panels. Each of the support columns may include a first raised mid-section extending into a first body panel and a second raised mid-section extending into a second body panel.

These and other features and improvements of the present application and the resultant patent will become apparent to one of ordinary skill in the art upon review of the following detailed description when taken in conjunction with the several drawings and the appended claims.

DETAILED DESCRIPTION

Figure 2:
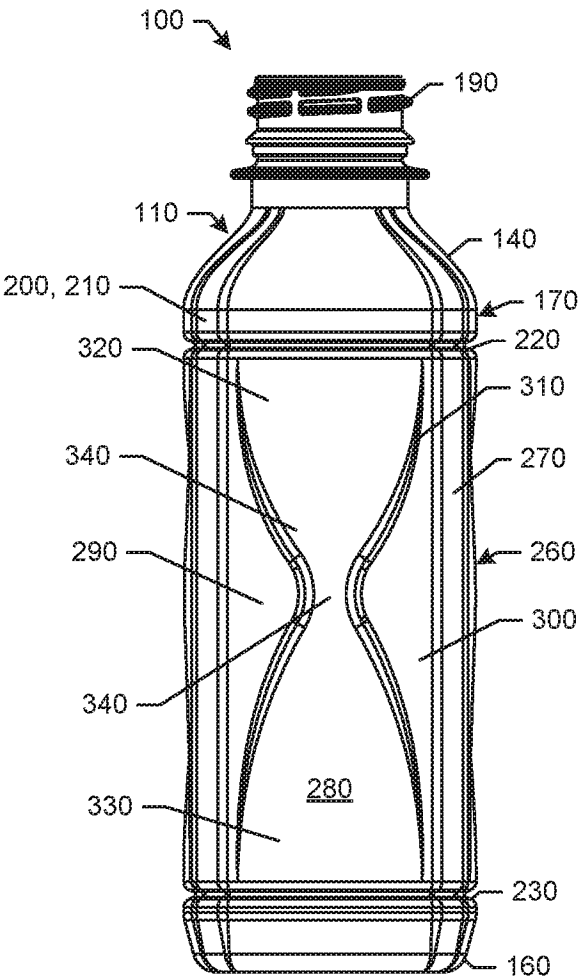
FIG. 2 is a front plan view of the hot fill container of FIG. 1.
Figure 1:
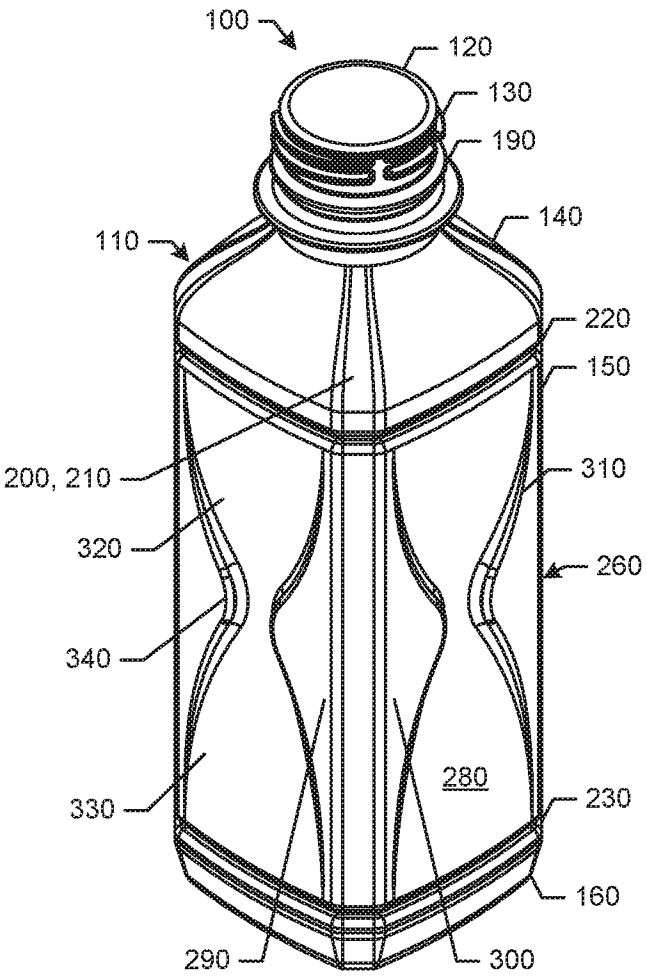
FIG. 1 is a perspective view of a hot fill container as may be described herein.
Figure 4:
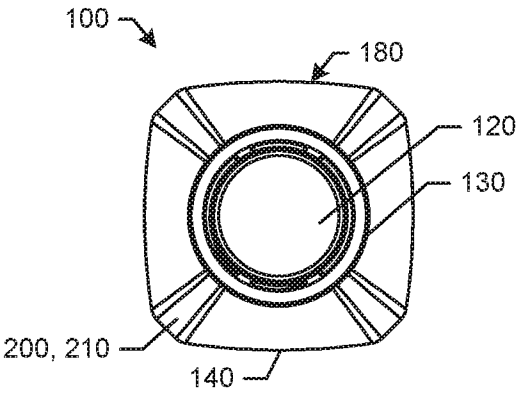
FIG. 4 is a top plan view of the hot fill container of FIG. 1.
Figure 5:
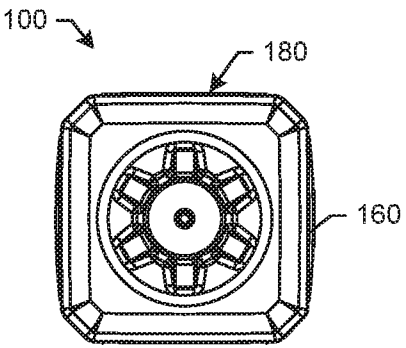
FIG. 5 is a bottom plan view of the hot fill container of FIG. 1.
Figure 3:
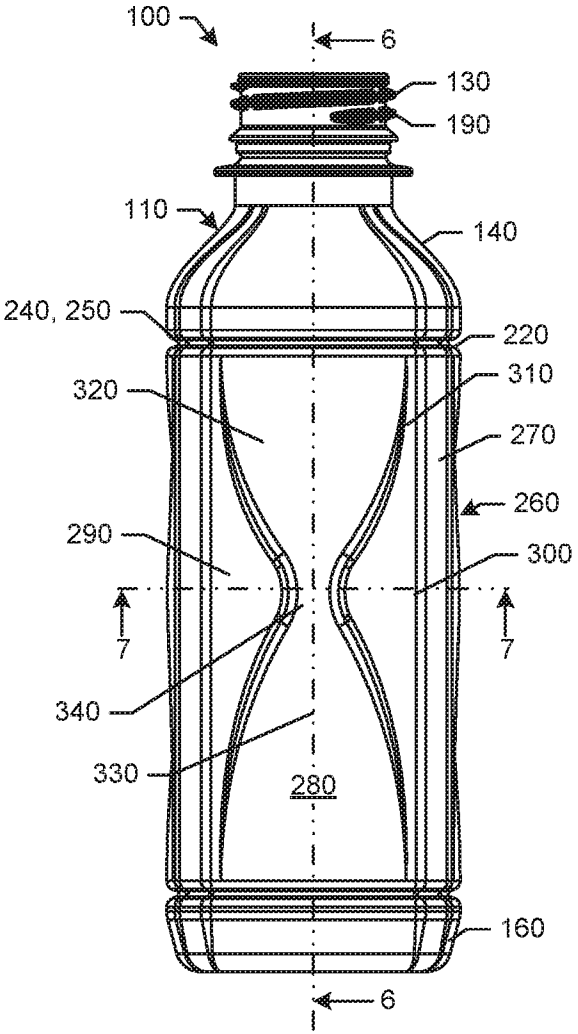
FIG. 3 is a side plan view of the hot fill container of FIG. 1.
Figure 7:
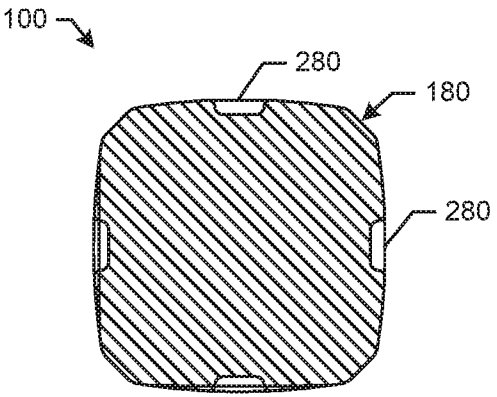
FIG. 7 is a sectional view of the hot fill container of FIG. 3 taken along line 7-7.
Figure 6:
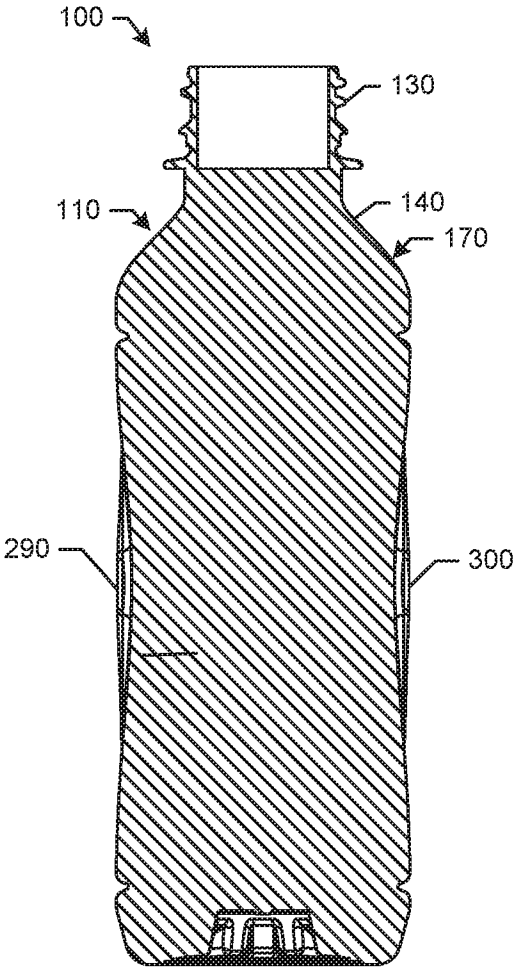
FIG. 6 is a sectional view of the hot fill container of FIG. 3 taken along line 6-6.

Referring now to the drawings in which like numerals refer to like elements throughout the several views, FIGS. 1-7 show a container 100 as may be described herein. The container 100 may be in the shape of a bottle 110 and the like. The bottle 110 may have any suitable size, shape, or configuration. The bottle 110 may be made from an injection molded preform. The preform may be made from various types of polymer resins. These polymer resins may include polyesters, polyolefins, polypropylene, polycarbonates, nitrates, and copolymers thereof. Biaxially oriented polyethylene terephthalate ("PET") may be commonly used. Other materials such as polylactide acid ("PLA") and the like also may be used herein. The polymers may be clear or opaque. Other types of materials may be used herein.

Generally described, the bottle 110 may include an open mouth 120, a finish 130, a shoulder 140, a body section 150, and a base 160 in any desired size, shape, or configuration. In this example, the bottle 110 may have a substantially rectangular configuration 170. Specifically, the body section 150 may have a substantially square cross-section 180 along the length thereof. Other components and other configurations may be used herein.

The open mouth 120 and the finish 130 may be largely of conventional design. The finish 130 may have one or more threads 190 thereon. The finish 130 and the threads 190 may be sized to accommodate a closure (not shown) thereon. The closure may be largely of conventional design.

The shoulder 140 may be largely dome like in shape and may expand in size and shape from the circular finish 130 downward to the substantially square cross-section 180 of the body section 150. Each corner 200 of the shoulder 140 may have a taper 210 formed therein. The taper 210 avoids any type of sharp edge given the use of the substantially square cross-section 180. The size, shape, and configuration of the shoulder 140 may vary.

The body section 150 may extend from the shoulder 140 to the base 160. The body section 150 may be separated from the shoulder 140 by an upper circumferential groove 220. The body section 150 may be separated from the base 160 by a lower circumferential groove 230. The circumferential grooves 220, 230 may be in the form of an indentation 240 within a sidewall 250 of the bottle 110. The size, shape, and configuration of the circumferential grooves 220, 230 and the indentations 240 may vary. Other components and other configurations may be used herein.

Each corner 200 of the body portion 150 may have a support column 260 formed therein. Each support column 260 may extend from the upper circumferential groove 220 to the lower circumferential groove 230. Each support column 260 may include a taper 270 about each corner 200 similar to that described above. The support columns 260 may define body panels 280 therebetween. The support columns 260 each may have a first side wave or raised mid-section 290 extending into a first body panel and a second side wave or raised mid-section 300 extending into a second body panel. As a result, the body panels 280 have a substantially hour glass shape 310 with an upper section of reducing width 320 and a lower section of increasing width 330. The raised mid-sections 290, 300 also increase in dimension with respect to the body panels 280 such that the body panels 280 may be substantially flush with the taper 270 of the support columns 260 about the upper circumferential groove 220 and the lower circumferential groove 230 but may increase in dimension about an apex 340 of each wave or raised mid-section 290. Specifically, the body panels 280 about the apex 340 may be an indentation 240 within the sidewall 250. The respective depth and width of the raised mid-sections 290, 300 and the body panels 280 may vary. Other components and other configurations may be used herein.

The base 170 may extend from the body section 150. The base 170 may be separated from the body section 150 by the lower circumferential groove 230. The base 170 may be of conventional design and may have any suitable size, shape, or configuration. The base 170 may be similar in design to those generally used in cold fill processes.

The bottle 110 herein may be intended for a beverage size of about 250 milliliters with the use of a standard 28 millimeter finish 130 and a standard base 170. The bottle 110 may have an overall height of about 150 millimeters or so. The bottle 110, and the features thereof, however, may be sized up or down as may be desired. At the 250 milliliter size, the bottle 110 may use about 15 grams or less of a PET material or other types of polymer resins. The body portion 150 of the bottle 110 may have a width of about 49 millimeters and a length of about 88 millimeters. The body panels 280 may be indented about the apex 340 of each raised mid-section 290, 300 by about 2.4 to about 2.8 millimeters or so. The current example may be about 2.6 millimeters. Different sizes and shapes may be used herein.

In use, the bottle 110 may be filled in a conventional hot fill process and capped with a closure in a conventional capping station. As the beverage within the bottle 110 cools, the beverage will contract and begin to pull a vacuum therein. As opposed to a conventional hot fill container that may be designed to accommodate the vacuum by deforming about the base, the bottle 110 herein has improved rigidity given the use of the support columns 260 and the body panels 290 in the body section 150. Specifically, the raised mid-sections 290, 300 of the support columns 260 increases the overall surface area so as to allow for increased pull across the body panels 290 to create more rigidity in the corners 200 of the support columns 260. The pull on the support panels 260 created by the vacuum thus serves to increase the overall rigidity so as to maintain the integrity and shape of the bottle 110. If the total surface area under the neck ring is about 24,381 square millimeters and the surface area of the lower section 160 is about 15,773 square millimeters, than the overall ratio of the flexing lower section 160 to the bottle 110 as a whole may be about 64.7 percent. The reduction in diameter of the lower section 160 may be less than about 1.5% or so. Moreover, the support columns 260 may remain substantially static over increasing vacuum pressure as compared to conventional bottles. A label or other type of wrapper may be affixed to the bottle 110 in whole or in part in a conventional manner.

Significantly, the use of the support columns 260 provides such rigidity with a reduced amount of material. Even at the 250 milliliter size, conventional hot fill bottles may require additional material, particularly if the bottle accommodates the vacuum through the base. The reduced amount of material thus provides a significant cost savings in a hot fill bottle. The bottle 110 herein thus may be ultra-light but with improved rigidity. Given the use of less than about 15 grams of material for a 250 milliliter bottle, the ratio of material to size thus may be about one (1) to seventeen (17) or less.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. A container for a beverage filled in a hot fill process, comprising:

a finish;

a body section; and a base;

the body section comprising a plurality of support columns and a plurality of body panels;

wherein each of the plurality of support columns comprise a first raised midsection extending into a first body panel and a second raised mid-section extending into a second body panel; and wherein each of the plurality of support columns is flush with each of the plurality of body panels about an upper circumferential groove and a lower circumferential groove and wherein each of the plurality of body panels continuously decreases in diameter from the upper circumferential groove and the lower circumferential groove to about an apex of the first and section raised midsections.

2. The container of claim 1, further comprising a dome and wherein the dome is separated from the body section by the upper circumferential groove.

3. The container of claim 1, wherein the base is separated from the body section by the lower circumferential groove.

4. The container of claim 1, wherein the plurality of support columns comprises a plurality of corner support columns.

5. The container of claim 1, wherein each of the plurality of support columns comprises a taper about a corner thereof.

6. The container of claim 1, wherein each of the plurality of body panels comprises an area of reducing width extending from the upper circumferential groove to the apex and an area of increasing width extending from the apex to the lower circumferential groove.

7. The container of claim 1, wherein each of the plurality of body panels comprises a substantial hour glass configuration.

8. The container of claim 1, wherein each of the plurality of body panels comprises an indentation in a sidewall.

9. The container of claim 1, further comprising four support columns and four body panels.

10. The container of claim 1, wherein the body section comprises a substantially square cross-section.

11. The container of claim 1, wherein the container comprises a 250 milliliter bottle.

12. The container of claim 1, further comprising less than about 15 grams of a thermoplastic.

13. The container of claim 1, wherein a ratio of material in terms of grams to size in terms of milliliters comprises about one (1) to seventeen (17) or less.

* * * * *